US008167560B2

(12) United States Patent
Liang

(10) Patent No.: US 8,167,560 B2
(45) Date of Patent: May 1, 2012

(54) TURBINE AIRFOIL WITH AN INTERNAL COOLING SYSTEM HAVING ENHANCED VORTEX FORMING TURBULATORS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 558 days.

(21) Appl. No.: 12/396,678

(22) Filed: Mar. 3, 2009

(65) Prior Publication Data

US 2010/0226761 A1 Sep. 9, 2010

(51) Int. Cl.
*F01D 5/18* (2006.01)

(52) U.S. Cl. ..... 416/97 R

(58) Field of Classification Search ..... 416/96, 416/95, 96 R, 97 R
See application file for complete search history.

(56) References Cited

U.S. PATENT DOCUMENTS

| | | | | |
|---|---|---|---|---|
| 4,775,296 | A | 10/1988 | Schwarzmann et al. | |
| 5,356,265 | A | 10/1994 | Kercher | |
| 5,472,316 | A | 12/1995 | Taslim et al. | |
| 5,738,493 | A | 4/1998 | Lee et al. | |
| 5,797,726 | A | 8/1998 | Lee | |
| 6,089,826 | A | 7/2000 | Tomita et al. | |
| 6,174,134 | B1 | 1/2001 | Lee et al. | |
| 6,609,884 | B2 | 8/2003 | Harvey | |
| 6,974,308 | B2 | 12/2005 | Halfmann et al. | |
| 6,984,102 | B2 | 1/2006 | Bunker et al. | |
| 6,984,103 | B2 * | 1/2006 | Lee et al. | 415/115 |
| 7,008,179 | B2 | 3/2006 | Rinck et al. | |
| 7,094,031 | B2 | 8/2006 | Lee et al. | |
| 7,097,425 | B2 | 8/2006 | Cunha et al. | |
| 7,156,620 | B2 | 1/2007 | Papple | |
| 7,217,095 | B2 | 5/2007 | Pietraszkiewicz et al. | |
| 7,278,460 | B2 * | 10/2007 | Grunstra et al. | 164/28 |
| 2002/0025248 | A1 | 2/2002 | Lee et al. | |
| 2002/0119047 | A1 * | 8/2002 | Starkweather | 416/97 R |
| 2003/0049125 | A1 | 3/2003 | Bolms et al. | |
| 2006/0201651 | A1 * | 9/2006 | Grunstra et al. | 164/369 |
| 2007/0048133 | A1 * | 3/2007 | Palmer et al. | 416/97 R |
| 2007/0071601 | A1 * | 3/2007 | Papple | 416/97 R |
| 2008/0170945 | A1 | 7/2008 | Barrett | |
| 2009/0104042 | A1 * | 4/2009 | Liang | 416/97 R |

FOREIGN PATENT DOCUMENTS

| | | | |
|---|---|---|---|
| EP | 1340884 | A2 | 3/2003 |
| EP | 1640563 | A2 | 3/2006 |

* cited by examiner

*Primary Examiner* — Nathan Ha

(57) ABSTRACT

A turbine airfoil usable in a turbine engine and having at least one cooling system. At least a portion of the cooling system may include one or more cooling channels having a plurality of turbulators protruding from an inner surface and positioned generally nonorthogonal and nonparallel to a longitudinal axis of the airfoil cooling channel. The cooling channel may also include a plurality of vortex enhancers protruding from an inner surface forming the cooling channel and positioned nonparallel to the turbulators. In one embodiment, the vortex enhancers may be positioned generally orthogonal to the turbulators. The configuration of turbulators and vortex enhancers creates a higher internal convective cooling potential for the blade cooling passage, thereby generating a high rate of internal convective heat transfer and attendant improvement in overall cooling performance. This translates into a reduction in cooling fluid demand and better turbine performance.

20 Claims, 5 Drawing Sheets

TURBINE AIRFOIL WITH AN INTERNAL COOLING SYSTEM HAVING ENHANCED VORTEX FORMING TURBULATORS

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. While advances have been made in the cooling systems in turbine vanes, a need still exists for a turbine vane having increased cooling efficiency for dissipating heat and passing a sufficient amount of cooling air through the vane.

SUMMARY OF THE INVENTION

This invention relates to a turbine airfoil cooling system configured to cool internal and external aspects of a turbine airfoil usable in a turbine engine. In at least one embodiment, the turbine airfoil cooling system may be configured to be included within a turbine blade. While the description below focuses on a cooling system in a turbine blade, the cooling system may also be adapted to be used in a stationary turbine vane. The turbine airfoil cooling system may be formed from a cooling system having one or more cooling channels having any appropriate configuration. The cooling channels may include a plurality of turbulators for creating vortices within the cooling channels. The cooling system may also include vortex enhancers positioned between the turbulators to increase the internal convective cooling potential of the cooling system, thereby increasing the overall performance of the cooling system.

The turbine airfoil may be formed from any appropriate configuration. In particular, the turbine airfoil may be formed from a generally elongated hollow airfoil formed from an outer wall, and having a leading edge, a trailing edge, a pressure side, a suction side, a root at a first end of the airfoil and a tip at a second end opposite to the first end. The turbine airfoil includes a cooling system positioned within interior aspects of the generally elongated hollow airfoil. The cooling system may include at least one cooling channel in the generally elongated hollow airfoil formed from an inner surface. A plurality of turbulators may extend from the inner surface into the at least one cooling channel and be positioned non-orthogonally and nonlinearly to a longitudinal axis of the at least one cooling channel. A plurality of vortex enhancers may protrude from the inner surface of the at least one cooling channel. The vortex enhancers may be skewed such that the vortex enhancers are positioned nonorthogonally and nonlinearly to the turbulators and extend between the turbulators.

The turbulators may be skewed relative to the longitudinal axis of the cooling channel. In particular, the turbulators is positioned at an angle of between about 20 degrees and about 70 degrees, between about 35 degrees and about 55 degrees, or at an angle of about 45 degrees relative to the longitudinal axis of the cooling channel. The turbulators may be spaced from adjacent turbulators a distance between about one width of the turbulator and about three widths of the turbulator. The turbulator may have a cross-section with rounded outer corners and a rounded intersection between the inner surface and the turbulator on the upstream side. The turbulator may have a rounded intersection between the inner surface and the turbulator on the downstream side.

The vortex enhancers may be positioned between 30 degrees and 90 degrees relative to the turbulators. In one embodiment, the vortex enhancers may be positioned at about 60 degrees relative to the turbulators. The vortex enhancers may be positioned generally orthogonal to the turbulators. The vortex enhancers may have a height from the inner surface of the cooling channel that is about one half of a height of the turbulators.

As the cooling fluid, which may be, but is not limited to air, flows through the skewed turbulator, the leading edge of the turbulator trips the thermal boundary layer of the cooling fluid. The turbulent cooling fluids form a vortex downstream of the turbulator that rolls along the length of the turbulator. However, the vortex rolls downstream and away from the turbulator by the incoming cooling fluids flowing over the turbulator. The vortex continues to increase in diameter as the vortex rolls away from the turbulator. The vortex enhancers direct the vortices across the flow of cooling fluids and cause the vortices to vortex about each vortex enhancer, thereby creating highly effective convention for the cooling channel. This unique vortex enhancer cooling arrangement in conjunction with the turbulator creates higher internal convective cooling potential for the turbine blade cooling channel, thus generating a high rate of internal convective heat transfer and efficient overall cooling system performance. This performance equates to a reduction in cooling demand and better turbine engine performance.

An advantage of this invention is that the turbulators and the vortex enhancers increase the cooling efficiency of the airfoil.

Another advantage of this invention is that an airfoil cooling system having multiple cooling channels with turbulators and vortex enhancers provide the cooling design flexibility for tailoring exterior airfoil heat loads to achieve a more uniform metal temperature.

Still another advantage of this invention is that the turbulators and the vortex enhancers provide higher overall internal convective cooling enhancement with a reduction in cooling flow demand, which correlates better turbine engine performance.

Another advantage of this invention is that the turbulators and vortex enhancers may be positioned at angles such that interaction between old vortices and newly formed vortices formed by the incoming fluid cooling flow along the turbulator may be eliminated, thereby creating a higher heat transfer augmentation.

Yet another advantage of this invention is that the turbulators and vortex enhancers cause an increased breakdown of the vortices that induces higher turbulence levels, which translates to higher heat transfer coefficient.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
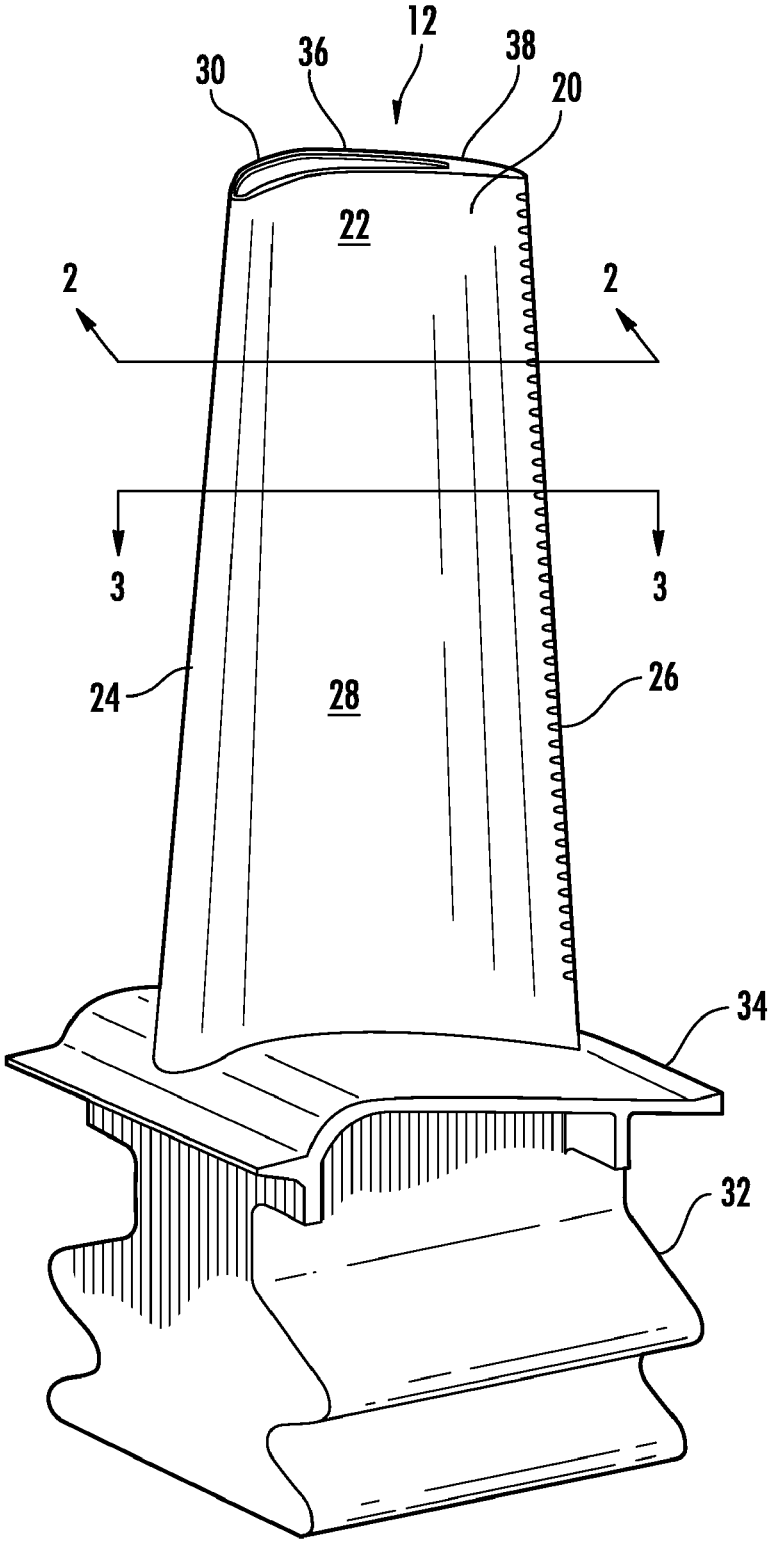
FIG. 1 is a perspective view of a turbine airfoil having features according to the instant invention.
Figure 2:
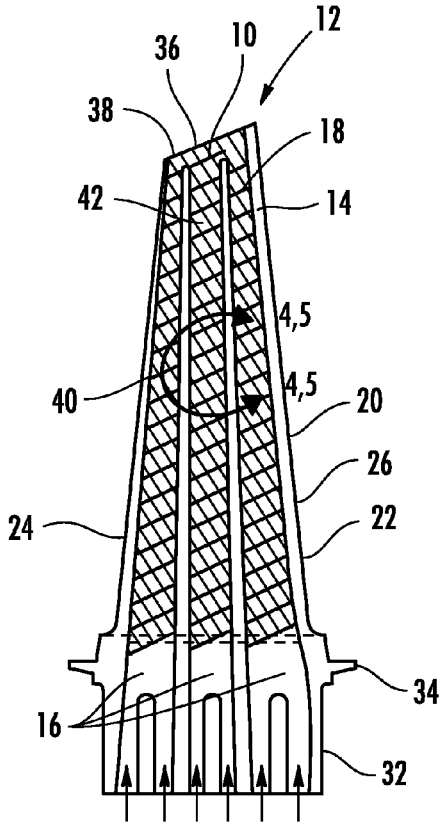
FIG. 2 is a cross-sectional view of the turbine airfoil shown in FIG. 1 taken along line 2-2.
Figure 3:
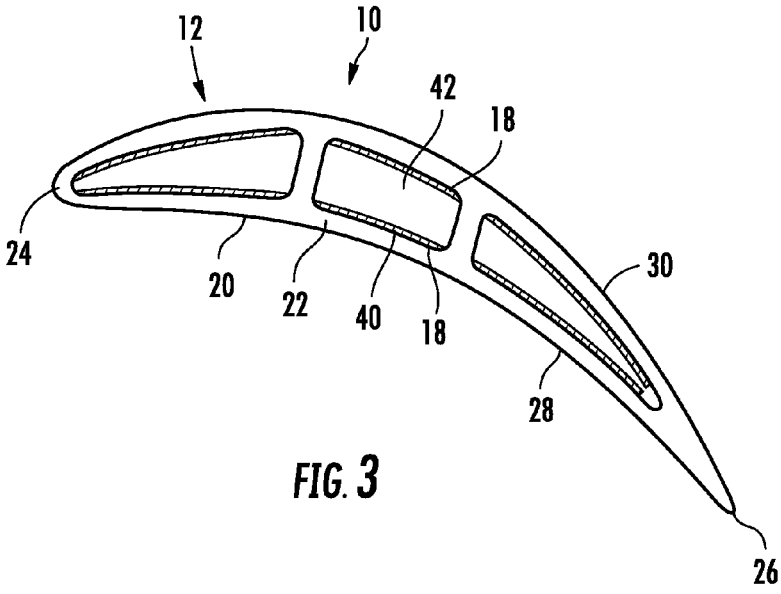
FIG. 3 is a cross-sectional view taken along section line 3-3 in FIG. 2.

As shown in FIGS. 1-6, this invention is directed to a turbine airfoil cooling system 10 configured to cool internal and external aspects of a turbine airfoil 12 usable in a turbine engine. In at least one embodiment, the turbine airfoil cooling system 10 may be configured to be included within a turbine blade, as shown in FIGS. 1-6. While the description below focuses on a cooling system 10 in a turbine blade 12, the cooling system 10 may also be adapted to be used in a stationary turbine vane. The turbine airfoil cooling system 10 may be formed from a cooling system 10 having one or more cooling channels 16 having any appropriate configuration, as shown in FIGS. 2 and 3. The cooling channels 16 may include a plurality of turbulators 18 for creating vortices within the cooling channels 16. The cooling system 10 may also include vortex enhancers 14 positioned between the turbulators 18 to increase the internal convective cooling potential of the cooling system, thereby increasing the overall performance of the cooling system 10.

The turbine airfoil 12 a generally elongated hollow airfoil 20 formed from an outer wall 22. The generally elongated hollow airfoil 20 may have a leading edge 24, a trailing edge 26, a pressure side 28, a suction side 30, a root 32 at a first end 34 of the airfoil 20 and a tip 36 at a second end 38 opposite to the first end 34. The generally elongated hollow airfoil 20 may have any appropriate configuration and may be formed from any appropriate material. The cooling system 10 is positioned within interior aspects of the generally elongated hollow airfoil. One or more cooling channels 16 of the cooling system 10 may be positioned in the generally elongated hollow airfoil 20 and formed from an inner surface 40. The inner surface 40 may define the cooling channel 16. The cooling channel 16 may have any appropriate cross-sectional shape. The cooling channel 16 may be positioned at the leading edge 24, the mid-chord section 42, or the trailing edge 26.

The cooling channel 16 may include a plurality of turbulators 18 extending from the inner surface 40 into the cooling channel 16 and skewed such that the turbulator 18 may be positioned nonorthogonally and nonlinearly to a longitudinal axis 44 of the cooling channel 16. In particular, the one or more of the turbulators 18 may be positioned at an angle of between about 20 degrees and about 70 degrees relative to the longitudinal axis 44 of the cooling channel 16. In another embodiment, one or more of the turbulators 18 may be positioned at an angle of between about 35 degrees and about 55 degrees relative to the longitudinal axis 44 of the cooling channel 16. In yet another embodiment, one or more of the turbulators 18 may be positioned at an angle of about 45 degrees. In such as position, the leading edge of the turbulator 18, which is the upstream corner 46, trips the thermal boundary layer of cooling fluids flowing through the cooling channel 16 and causes a vortex to form downstream of the turbulator 18. The vortex flows generally along a downstream side of the turbulator 18 toward a trailing edge of the turbulator 18, which is the downstream corner 48. As the vortices propagate along the full length of the downstream side of a turbulator 18, the boundary layer becomes progressively more disturbed or thickened, and consequently the tripping of the boundary layer becomes progressively less effective. The boundary layer growth creates significantly reduced heat transfer augmentation.

Figure 4:
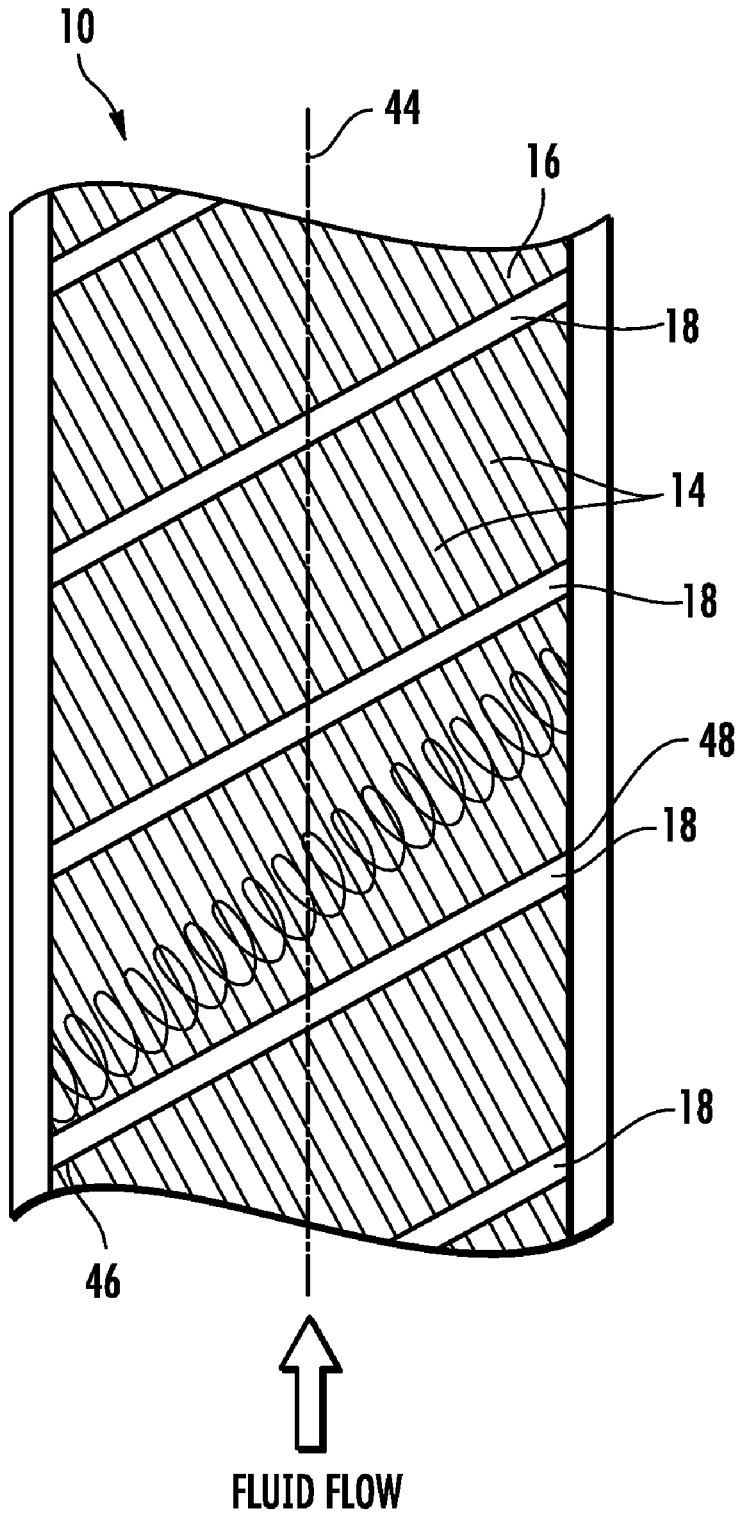
FIG. 4 is a partial detailed view of the cooling system in the turbine airfoil shown in FIG. 2 taken along line 4-4 in FIG. 2.
Figure 5:
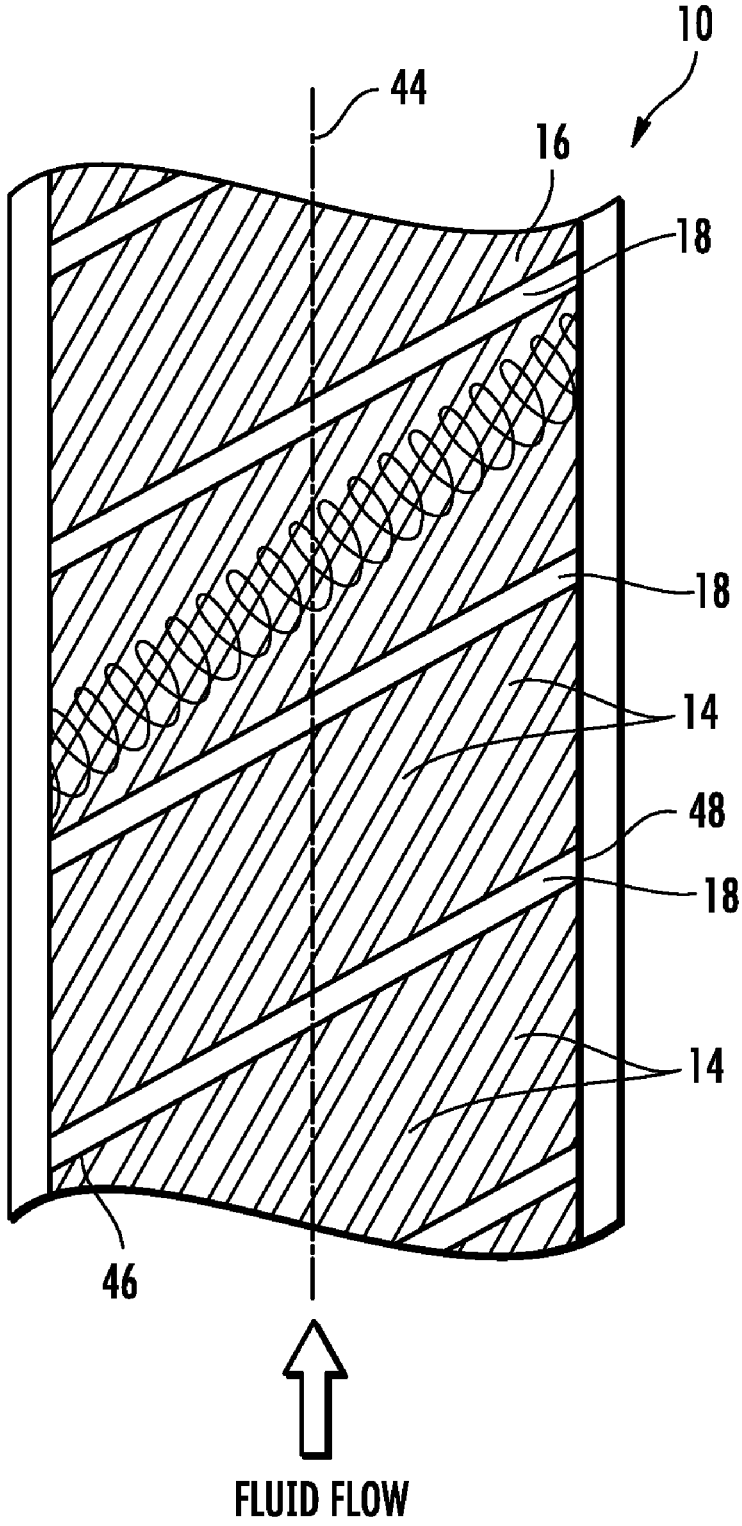
FIG. 5 is a partial detailed view an alternatively configured cooling system in the turbine airfoil shown in FIG. 2 taken along line 4-4 in FIG. 2.

The reduced heat transfer augmentation caused by the boundary layer growth may be compensated for with the vortex enhancers 14. The vortex enhancers 14 may protrude from the inner surface 40 of the cooling channel 16 and extend between turbulators 18. The vortex enhancers 14 may be skewed such that the vortex enhancers 14 are positioned nonorthogonally and nonlinearly to the turbulators 18. In one embodiment, the vortex enhancers 14 may be positioned inline with the longitudinal axis 44 of the cooling channel 16. In other embodiments, as shown in FIGS. 4 and 5, the vortex enhancers 14 may be skewed relative to the longitudinal axis 44 of the cooling channel 16. The vortex enhancers 14 may be positioned between 30 degrees and 90 degrees relative to the turbulators 18. In another embodiment, the vortex enhancers 14 may be positioned at about 60 degrees relative to the turbulators 18. The vortex enhancers 14 may be positioned generally orthogonal to the turbulators 18. The cooling system 10 may be tailored to each particular cooling requirement. In particular, the cooling system 10 may be tailored such that the vortex enhancers 14 match the airfoil external heat load. In particular, the angle at which the vortex enhancers 14 are positioned is determined by the heating load of the turbine airfoil 12. The cross-sectional shape of the vortex enhancer 14 may also vary and may be shaped based on the airfoil external heat load.

Figure 6:
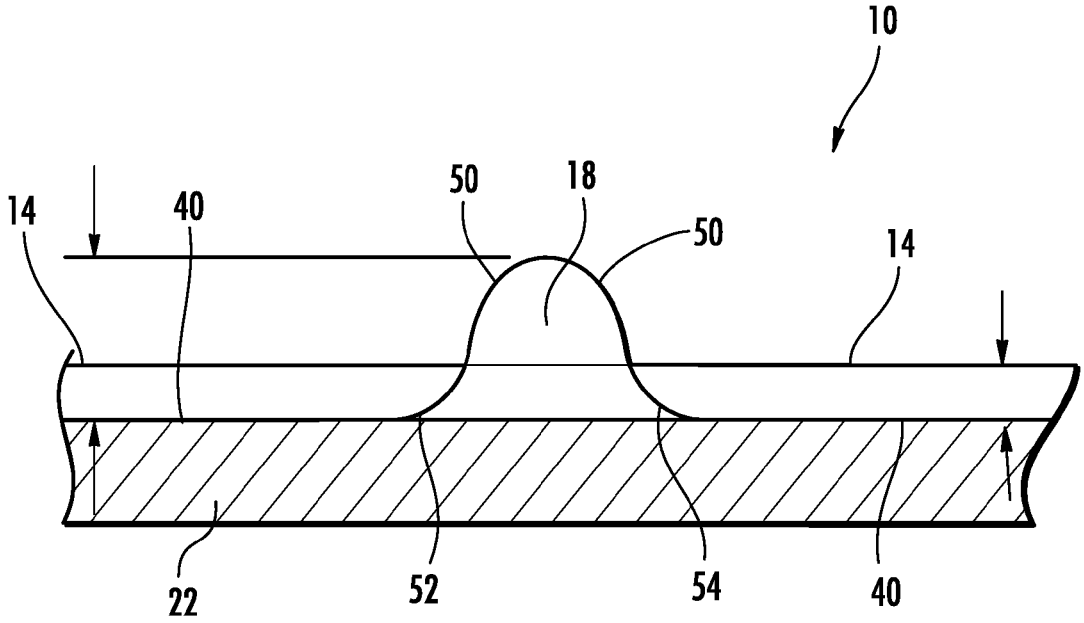
FIG. 6 is a partial cross-sectional view of a turbulator and a vortex enhancer.

One or more of the vortex enhancers 14 may have a height from the inner surface 40 of the cooling channel 16 that may be about one half of a height of a turbulator 18, as shown in FIG. 6. In other embodiments, the height of the vortex enhancers 14 may be up to no greater than half of the height of the turbulator 18. The turbulators 18 may be spaced from adjacent turbulators 18 a distance equal to a distance between about one width of the turbulator 18 and about three widths of the turbulator 18.

The turbulators 18 and vortex enhancers 14 may have cross-sections that are generally rectangular. In another embodiment, the turbulators 18 may have a cross-section with rounded outer corners 50 and a rounded intersection 52 between the inner surface 40 and the at least one turbulator 18 on the upstream side, as shown in FIG. 6. The turbulator 18 may also have a rounded intersection 54 between the inner surface 40 and the at least one turbulator 18 on the downstream side.

The pattern of turbulators 18 separated from each other by vortex enhancers 14 may be repeated for a portion or throughout an entire elongated hollow airfoil 20 on both the pressure and suction sides 28, 30.

During use, the cooling fluids may be passed into the cooling channel 16. The upstream corner 46 of the turbulator 18 trips the boundary layer and creates turbulence. The turbulent cooling fluids form a vortex downstream of the turbulator 18 that rolls along the length of the turbulator 18. However, the vortex rolls downstream and away from the turbulator 18 by the incoming cooling fluids flowing over the turbulator 18. The vortex continues to increase in diameter as the vortex rolls away from the turbulator 18. The vortex enhancers direct the vortices across the flow of cooling fluids and cause the vortices to vortex about each vortex enhancer, thereby creating highly effective convention for the cooling channel 16. This unique vortex enhancer cooling arrangement in conjunction with the turbulator 18 creates higher internal convective cooling potential for the turbine blade cooling channel 16, thus generating a high rate of internal convective heat transfer and efficient overall cooling system performance. This performance equates to a reduction in cooling demand and better turbine engine performance.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one cooling channel of the cooling system in the generally elongated hollow airfoil formed from an inner surface;

a plurality of turbulators extending from the inner surface into the at least one cooling channel and positioned nonorthogonally and nonlinearly to a longitudinal axis of the at least one cooling channel; and a plurality of vortex enhancers protruding from the inner surface of the at least one cooling channel, skewed such that the vortex enhancers are positioned nonorthogonally and nonlinearly to the turbulators and extending between turbulators;

wherein at least one of the vortex enhancers has a height less than a height of the turbulators.

2. The turbine airfoil of claim 1, wherein at least one of the turbulators is positioned at an angle of between about 20 degrees and about 70 degrees relative to the longitudinal axis of the cooling channel.

3. The turbine airfoil of claim 2, wherein at least one of the turbulators is positioned at an angle of between about 35 degrees and about 55 degrees relative to the longitudinal axis of the cooling channel.

4. The turbine airfoil of claim 3, wherein at least one of the turbulators is positioned at an angle of about 45 degrees.

5. The turbine airfoil of claim 1, wherein the vortex enhancers are positioned between 30 degrees and 90 degrees relative to the turbulators.

6. The turbine airfoil of claim 5, wherein the vortex enhancers are positioned at about 60 degrees relative to the turbulators.

7. The turbine airfoil of claim 1, wherein the vortex enhancers are positioned generally orthogonal to the turbulators.

8. The turbine airfoil of claim 1, wherein at least one of the vortex enhancers has a height from the inner surface of the cooling channel that is about one half of a height of the turbulators.

9. The turbine airfoil of claim 1, wherein at least one of the turbulators is spaced from adjacent turbulators a distance between about one width of the turbulator and about three widths of the turbulator.

10. The turbine airfoil of claim 1, wherein at least one turbulator has a cross-section with rounded outer corners and a rounded intersection between the inner surface and the at least one turbulator on the upstream side.

11. The turbine airfoil of claim 10, wherein at least one turbulator has a rounded intersection between the inner surface and the at least one turbulator on the downstream side.

12. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one cooling channel of the cooling system in the generally elongated hollow airfoil formed from an inner surface;

a plurality of turbulators extending from the inner surface into the at least one cooling channel and skewed such that the vortex enhancers are positioned nonorthogonally and nonlinearly to a longitudinal axis of the at least one cooling channel; and a plurality of vortex enhancers protruding from the inner surface of the at least one cooling channel, positioned nonorthogonally and nonlinearly to the turbulators and extending between turbulators;

wherein at least one of the turbulators is spaced from adjacent turbulators a distance between about one width of the turbulator and about three widths of the turbulator;

wherein at least one of the turbulators is positioned at an angle of between about 35 degrees and about 55 degrees relative to the longitudinal axis of the cooling channel.

13. The turbine airfoil of claim 12, wherein at least one of the turbulators is positioned at an angle of about 45 degrees.

14. The turbine airfoil of claim 12, wherein the vortex enhancers are positioned between 30 degrees and 90 degrees relative to the turbulators.

15. The turbine airfoil of claim 14, wherein the vortex enhancers are positioned at about 60 degrees relative to the turbulators.

16. The turbine airfoil of claim 12, wherein the vortex enhancers are positioned generally orthogonal to the turbulators.

17. The turbine airfoil of claim 12, wherein at least one of the vortex enhancers has a height from the inner surface of the cooling channel that is one half of a height of the turbulators.

18. The turbine airfoil of claim 12, wherein at least one turbulator has a cross-section with rounded outer corners and a rounded intersection between the inner surface and the at least one turbulator on the upstream side.

19. The turbine airfoil of claim 18, wherein at least one turbulator has a rounded intersection between the inner surface and the at least one turbulator on the downstream side.

20. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one cooling channel of the cooling system in the generally elongated hollow airfoil formed from an inner surface;

a plurality of turbulators extending from the inner surface into the at least one cooling channel and positioned nonorthogonally and nonlinearly to a longitudinal axis of the at least one cooling channel;

wherein at least one of the turbulators is positioned at an angle of between about 35 degrees and about 55 degrees relative to the longitudinal axis of the cooling channel;

a plurality of vortex enhancers protruding from the inner surface of the at least one cooling channel, skewed such that the vortex enhancers are positioned nonorthogonally and nonlinearly to the turbulators and extending between turbulators;

wherein the vortex enhancers are positioned generally orthogonal to the turbulators;

wherein at least one of the turbulators is spaced from adjacent turbulators a distance between about one width of the turbulator and about three widths of the turbulator;

wherein at least one of the vortex enhancers has a height from the inner surface of the cooling channel that is one half of a height of the turbulators; and wherein at least one turbulator has a cross-section with rounded outer corners and a rounded intersection between the inner surface and the at least one turbulator on the upstream and downstream sides.

* * * * *